US005203187A

United States Patent [19]

Kane

[11] Patent Number: 5,203,187

[45] Date of Patent: Apr. 20, 1993

[54] PORTABLE DOOR LOCK CLOSURE

[76] Inventor: James T. Kane, 1601 Dona Bay Dr., Nacomis, Fla. 34275

[21] Appl. No.: 902,341

[22] Filed: Jun. 22, 1992

[51] Int. Cl.[5] ..... E05B 17/18; E05B 13/00

[52] U.S. Cl. ..... 70/455; 70/428; 70/424; 70/211; 292/DIG. 2

[58] Field of Search ..... 70/455, 424, 428, 426, 70/DIG. 58, 158, 211, 209, 162, 163, 63, 232; 292/DIG. 2, 347

[56] References Cited

U.S. PATENT DOCUMENTS

| | | | |
|---|---|---|---|
| 901,409 | 10/1908 | Woolums | 70/63 |
| 1,221,354 | 4/1917 | Mitchell | 70/158 |
| 1,404,263 | 1/1922 | Bludworth | 70/18 |
| 2,131,060 | 9/1938 | Malluk | 70/158 |
| 2,469,973 | 5/1949 | Malluk | 70/232 |
| 2,785,564 | 3/1957 | Rossi | 70/232 |
| 3,245,240 | 4/1966 | DeForrest | 70/DIG. 58 |
| 3,636,742 | 1/1972 | Raney | 70/424 |
| 3,952,564 | 4/1976 | Maines | 70/424 |
| 4,254,888 | 3/1981 | Chandler | 70/158 |
| 4,561,273 | 12/1985 | Robinson | 70/424 |
| 4,798,069 | 1/1989 | DeForrest, Sr. | 70/211 |

FOREIGN PATENT DOCUMENTS

| | | | |
|---|---|---|---|
| 532379 | 8/1955 | Italy | 70/232 |
| 322171 | 11/1929 | United Kingdom | 70/DIG. 58 |

*Primary Examiner*—Richard E. Moore
*Assistant Examiner*—D. Boucher
*Attorney, Agent, or Firm*—David H. Semmes

[57] ABSTRACT

The present doorlock closure secures existing doors having conventional doorknobs against entry by enveloping the doorknob with opposed cavity compartments of knob confining segments. Upper and lower housing segments are hinged together such that they may mount elements which form a cam-lever, segment interlocking assembly. The assembly includes a spring-loaded latch and lockable latch lever in the upper segment and a corresponding cam latch release in the lower segment. The housing segments themselves are hinged together for facile clamping upon the doorknob of a door, securing it against entry by persons having a passkey to the doorknob which retains a turnkey lock therein.

1 Claim, 3 Drawing Sheets

PORTABLE DOOR LOCK CLOSURE

BACKGROUND OF THE INVENTION

The present closure is of the type which is known as a clam-shell locking apparatus. It is adapted as a portable lock closure to removably engage the external doorknob of a room which is to be secured as a second locking alternative, for example on a motel or hotel door. Its further utility serving as a supplemental lock for the domicile. After the device has been set, one may open the door from the inside for exit. The specific function of the device is to prevent others, who may have a key or passkey to doorknob of the room or home, from entering and it serves also as an extra lock on one door at night.

The portable closure device comprises upper and lower shell segments, the latter being hinged to the former for drop-away release and subsequent closure upon the doorknob. The lower segment retains a latch cam which is adapted to operatively engage a spring-loaded latch upon closure. The latch of the upper segment incorporates a latch and lever combination which may be opened by an appropriate key lock or the like. Among advantages achieved through the use of the device are the following. The door lock closure handily slips over a given doorknob and its compartments close around it; moreover, after closure it will swing 360 degrees on the doorknob, thereby making it impossible for an intruder to turn the knob. It is useful to protect either an ordinary door knob or one which contains its own axial key lock.

THE PRIOR ART

| INVENTOR | YEAR | PAT. NO. | TITLE |
|---|---|---|---|
| Kaskouras | 1949 | 2,458,002 | DOOR KNOB LOCK |
| De Forrest | 1966 | 3,245,240 | KNOB PROTECTOR |
| Marcy | 1983 | 4,391,111 | LATCHING MECHANISM FOR DISPENSER APPARATUS |
| Johnson | 1986 | 4,631,938 | ACCESSORY KEYHOLD LOCK |
| De Forrest, Sr. | 1989 | 4,798,069 | PROTECTING DEVICE FOR LEVER HANDLE DOOR LOCKS |
| Johnson | 1989 | 4,838,059 | COMBINED COVER AND ATTACHING MEANS FOR CONCEALING A DEADBOLT LOCK |
| Johnson | 1991 | 5,033,280 | SECURITY LOCK |
| Zaucha | 1991 | 5,079,935 | TRAPPED KEY LOCK |

SUMMARY OF INVENTION

The door lock closure of this invention has been created to secure existing doors, having conventional doorknobs. The closure as the doorknob with opposed housing compartments of clamshell knob confining segments, both upper and lower. Being hinged together, the segments themselves mount the elements which are necessary to form a cam-lever, plural segment locking assembly. The assembly includes a spring-loaded latch and lockable latch lever in an upper segment, and a corresponding cam latch lever release in the lower segment.

DRAWINGS

DESCRIPTION OF THE PREFERRED EMBODIMENTS

Figure 1:
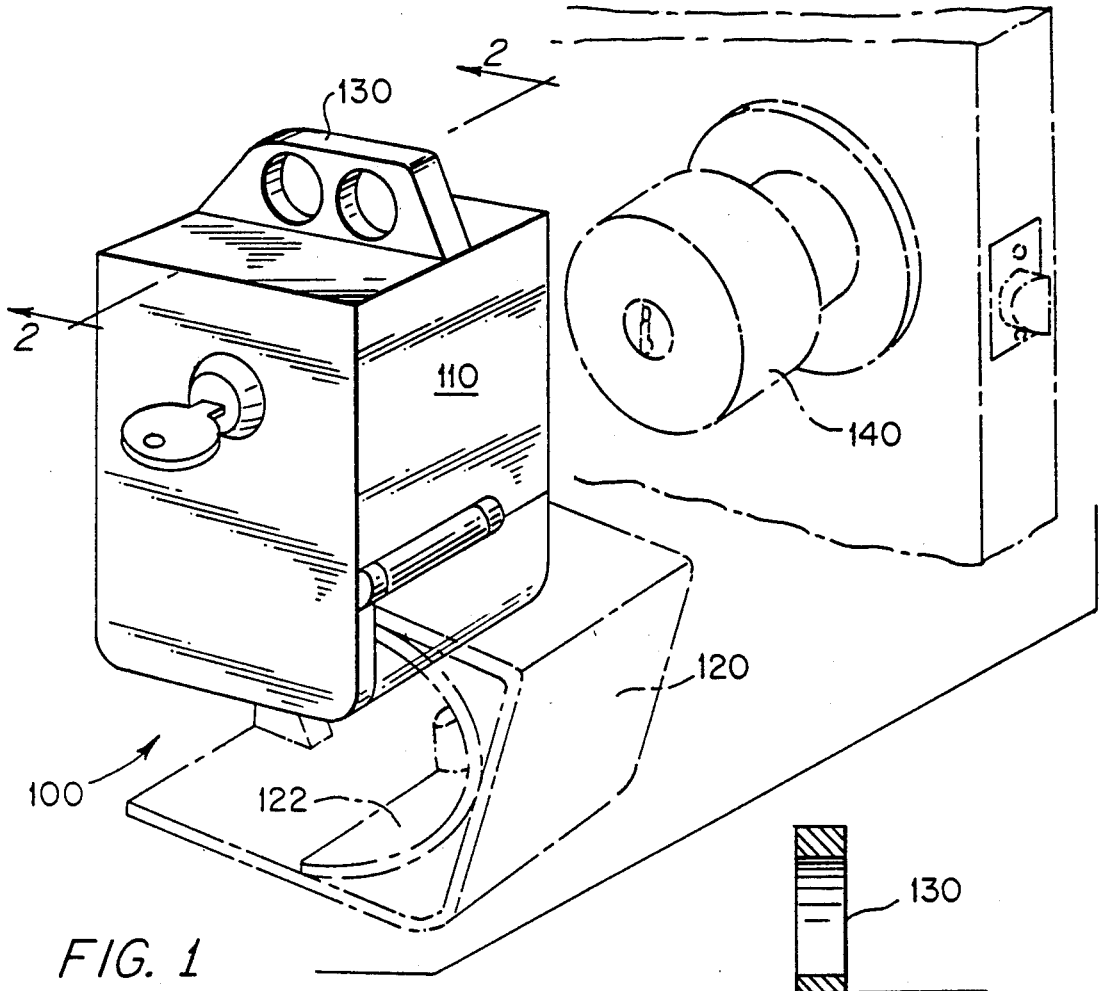
FIG. 1 is a view in perspective of a preferred form of invention wherein the respective upper and lower shell segments are closed together upon a conventional turn-key door knob. A portion of the closure is broken away to reveal the relationship of the device to the existing doorknob.
Figure 2:
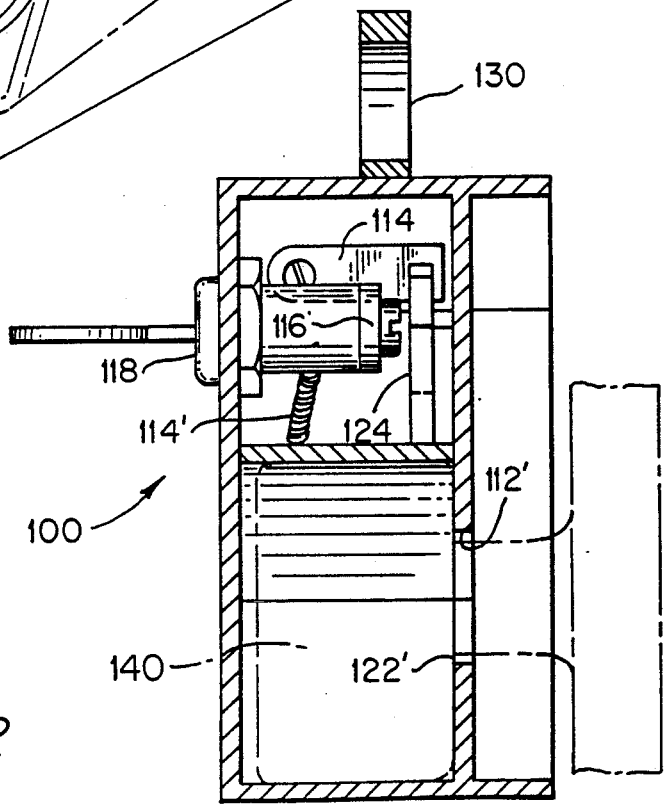
FIG. 2 is a section view in vertical elevation of the invention depicted in FIG. 1.

The door lock closure 100 is best represented by FIGS. 1 and 2. This closure, which is adapted to close upon an existing doorknob consists essentially of two coactively arranged shell segments 110 and 120. The upper shell segment 110 defines on its interior, one-half portion of a knob cavity 112, which together with the corresponding cavity 112 forms a knob confining compartment. Cavities 112–122 define a rearward knob shaft semicircular cut out 112'–122' for the knob handle shaft. Pivoted to the interior wall of the upper segment 110 is a latch 114, said latch having restrained connection with latch spring 114'. The latch 114 is coactively mounted with respect to latch lever 116, the latch lever being activated or deactivated by access key and tumbler assembly 118.

Referring to lower shell segment 120, its cavity 122 is disposed such that when upper and lower segments are brought together over the doorknob, the two opposed cavities 112 and 122 form the complete confining compartment for the knob 140. As in its counterpart, cavity 122 defines a semicircular knob shaft cut out 122'.

The lower segment 120 has a cam 124 which is fixed to the upper portion thereof, said cam bearing at its upper end a latch receptor 124' locking the latch against movement, excepting as and when the latch 114 is again activated by access key and tumbler assembly 118.

In that the respective shell segments 110–120 are hinges connected on the side walls thereof, the lowermost segment 120 being the heaviest, will fall of its own weight, when unlatched from the upper segment 110, thereby releasing at least the lower portion of the compartment from enveloping connection with the doorknob which has previously been secured. Clearly, when this takes place, the topmost segment 110 is simply lifted off doorknob 140 and the security provided by the housing assembly is removed altogether. The device is portable once again.

Figure 3:
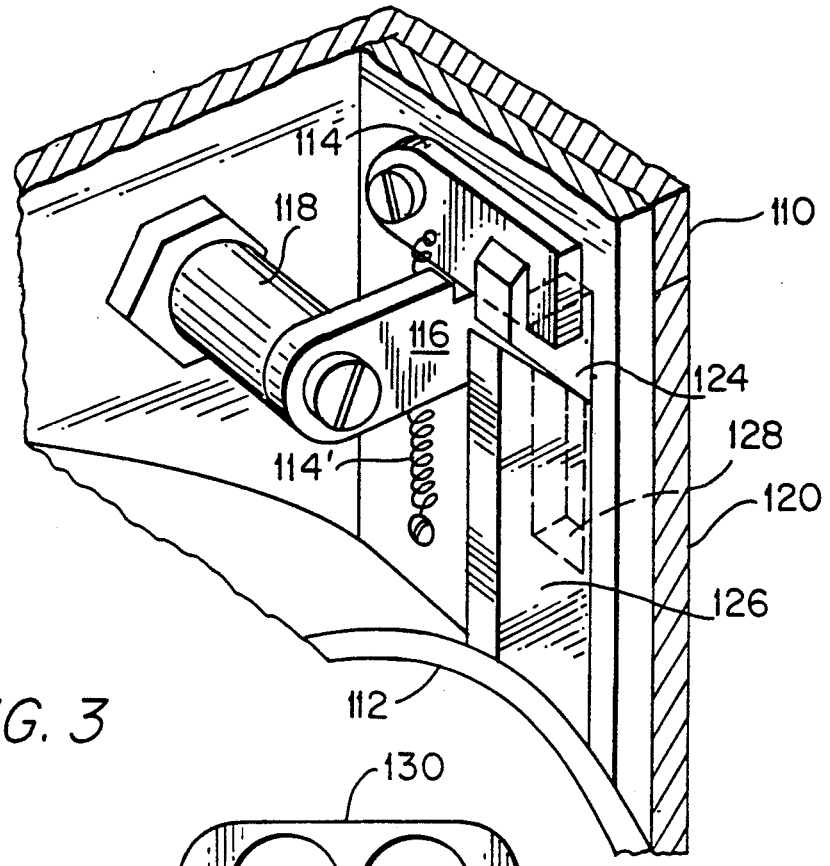
FIG. 3 is a fragmentary view taken along the lines 2—2 of FIG. 1 in perspective of invention, a portion thereof being broken away to illustrate the interrelationship of latching components.
Figure 4:
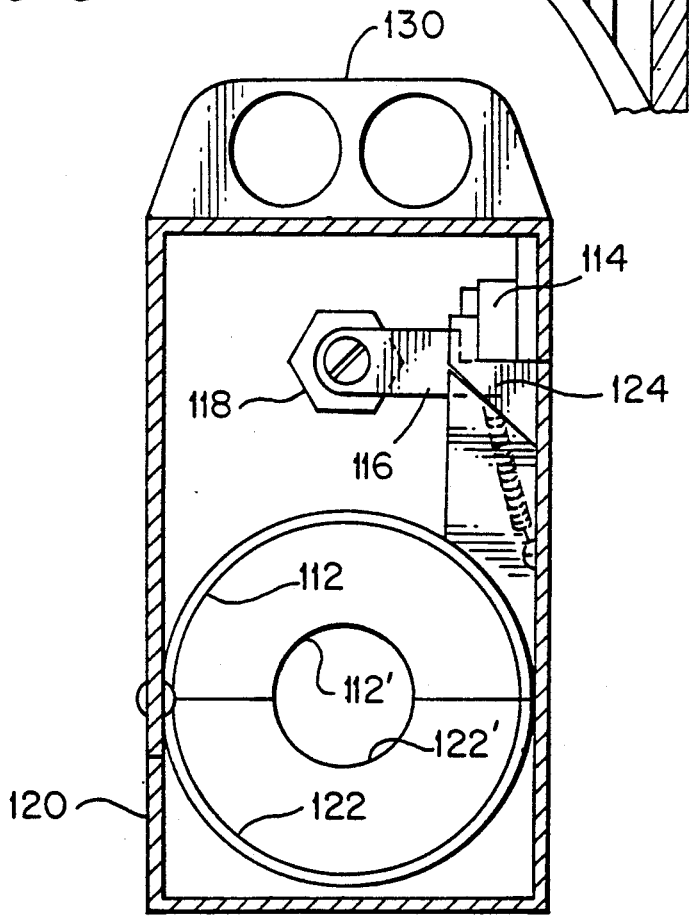
FIG. 4 is a vertical section of invention, taken from the rear thereof.
Figure 5:
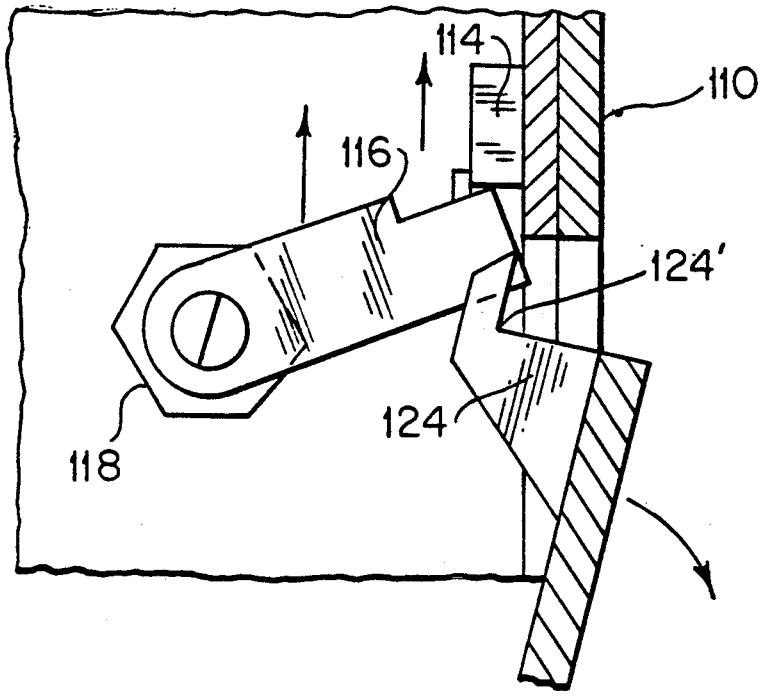
FIGS. 5 and 6 are enlarged fragmentary sections of the key and latch assemblies depicted in FIGS. 2, 3, and 4.
Figure 6:
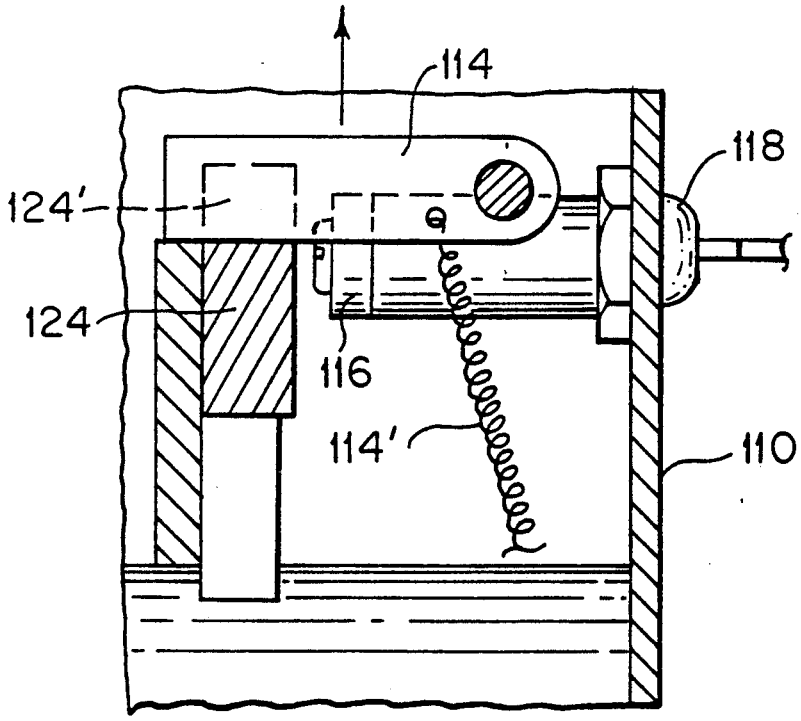

Referring to FIG. 3, the slide 126 seats cam 124 into registry with latch 114. The cut-out 128 permits entry of the cam 124 as the bottom segment 120 is rated into locking position. See FIGS. 4, 5 and 6.

An upstanding finger engageable handle 130 protrudes from atop the upper shell segment 110.

I claim:

1. In a portable clamshell doorknob closure of box configuration, wherein the closure defines opposed front and rear walls, top, bottom and divisible side walls and wherein one side wall bears a hinge, located intermediate its ends to connect the bottom wall and a portion of said one side wall, whereby to form upper and lower shell segments, said segments each defining opposed doorknob enveloping cavities:

a) a spring-loaded latch pivoted to the interior of said side wall; and b) a lockable latch lever with a locking means, the lever being pivoted to the interior of the front wall of the upper segment, in operative juxtaposition to the spring-loaded latch;

c) a latch cam and seat fixed to the interior of said other side wall;

d) a cam slide fixed to the upper shell segment rear wall, in latch contacting disposition relative to the latch cam;

whereby as the lower segment is closed against the upper segment, the latch cam and seat may trip the latch, locking the segments together and as the latch lever is sequentially activated, the lower shell segment will release from the upper segment to open the closure.

* * * * *